United States Patent [19]

Garland

[11] Patent Number: 4,678,356

[45] Date of Patent: Jul. 7, 1987

[54] EXTENDABLE WRITING INSTRUMENT

[76] Inventor: Thomas N. Garland, 617 W. Kiowa Ave., Fort Morgan, Colo. 80701

[21] Appl. No.: 751,690

[22] Filed: Jul. 3, 1985

[51] Int. Cl.[4] ..... B43K 23/00

[52] U.S. Cl. ..... 401/95; 401/81; 401/82; 401/99

[58] Field of Search ..... 401/95, 99, 81, 82

[56] References Cited

U.S. PATENT DOCUMENTS

| | | | |
|---|---|---|---|
| 126,448 | 5/1872 | Davis . | |
| 272,700 | 2/1883 | Jaeger . | |
| 287,907 | 11/1883 | Collard . | |
| 331,941 | 12/1885 | Brougham . | |
| 544,533 | 8/1895 | Harpfer . | |
| 659,026 | 10/1900 | Goldsmith . | |
| 1,063,134 | 5/1913 | Norris . | |
| 1,063,189 | 6/1913 | Dutton . | |
| 1,281,223 | 10/1918 | Stepanchak . | |
| 1,292,893 | 1/1919 | Shatkin . | |
| 1,807,444 | 5/1931 | Shatkin . | |
| 1,839,897 | 1/1932 | Savoie . | |
| 1,866,072 | 7/1932 | Woelm . | |
| 1,970,399 | 8/1934 | Shatkin | 401/95 |
| 2,005,485 | 6/1935 | Wells . | |
| 2,303,273 | 11/1942 | Hendrick . | |
| 2,571,830 | 10/1951 | Buell . | |
| 2,627,843 | 2/1953 | Frentzel . | |
| 2,690,163 | 9/1954 | Randolph . | |
| 2,704,153 | 3/1955 | Florman . | |
| 3,709,620 | 1/1973 | Miyamoto . | |
| 4,167,350 | 9/1979 | Harris . | |

FOREIGN PATENT DOCUMENTS

| | | | |
|---|---|---|---|
| 1252736 | 12/1960 | France | 401/99 |
| 7197 | of 1887 | United Kingdom | 401/95 |

*Primary Examiner*—Steven A. Bratlie

*Attorney, Agent, or Firm*—John E. Reilly

[57] ABSTRACT

A mechanism for housing a writing or marking cartridge includes means for retaining the cartridge in a retracted position within the housing and means for extending the operative end of the cartridge beyond the housing and releasably locking it in place for use. The housing comprises an open end through which the operative end of the cartridge is extended, and a closed end which houses a retaining means for securing the cartridge in the retracted position. The retaining means includes an annular collar which houses a flexible center section having fingers adapted to capture the support end of the cartridge. The means for extending the cartridge comprises a telescoping helical coil member frictionally secured on its outer end to the interior of the housing and on its inner end to the cartridge.

11 Claims, 9 Drawing Figures

EXTENDABLE WRITING INSTRUMENT

This invention relates to writing implements and, more particularly, relates to a novel and improved writing instrument which allows a writing or marking element to be retracted in a protective housing and extended for use.

BACKGROUND AND FIELD OF THE INVENTION

One of the goals in the design of writing instruments is to provide a device which, when extended for use, is of sufficient length to be held comfortably in the hand, but which may also be retracted into a compact configuration for storage. Another important consideration is the need to isolate the marking element from contact with clothing, furniture and other articles when the element is not in use.

A common approach to the problem of isolating the writing or marking element is the familiar cap and barrel combination wherein a cap is placed over the end of the barrel which houses the element when it is not in use. Hereafter, the term "writing element" is used to refer either to a writing or marking element. The cap may then be removed and stored on the rear of the barrel when the implement is in use. Although this arrangement serves to isolate the writing element, there is generally no advantage offered in terms of reducing the size of the implement for storage. Further, the cap is often lost after it has been separated from the barrel.

Another common arrangement is a push top mechanism wherein a writing element is received in a tubular housing, the element having a compressible spring disposed about the writing end to provide a biasing force between the element and the writing tip end of the housing. The opposite end of the element typically engages a cam mechanism within the housing which moves the element between its extended and retracted positions. While these mechanisms serve to protect the writing element, they provide very little reduction in the overall size of the implement for purposes of storage. Furthermore, a major disadvantage of these mechanisms is that they are generally complex and have a large number of moving parts.

The present invention represents an improvement over the aforementioned prior art devices by providing a writing implement which allows the writing element to be extended to a convenient position for use or completely retracted into a compact, convenient package and which is simply constructed with a minimum of moving parts.

SUMMARY OF THE INVENTION

It is an object of the present invention to provide for a novel and improved writing implement in which a writing element can be stored in a compact housing and extended to a length sufficient to allow it to be held comfortably for use.

Another object of the present invention is to provide for a novel and improved writing implement in which a writing element is adapted to be retracted and positively locked into place within a housing or extended through an opening in the housing and locked into an extended position for use.

A further object of the present invention is to provide for a novel and improved means for releasably retaining a writing element firmly in a retracted position within a compact housing, and wherein the writing element is capable of being extended a substantial distance through the housing and locked in an extended position for use.

An additional object of the present invention is to provide in a writing instrument for a retractable body formed out of a thin, flat sheet which is simple and inexpensive to manufacture.

In accordance with the present invention, an extendable writing implement comprises a tubular housing having an inner surface, an outer surface and first and second ends, a writing element insertable within the housing and telescoping extension means received within the housing and preferably defined by a coiled portion formed from a flat resilient or spring-like sheet. The writing element includes an operative end which is extendable through the first end of the housing in cooperation with the extension means, the extension means having an outer portion which is engageable with the inner surface of the housing and an inner portion which is engageable with the element. The extension means is movable between a retracted position in which the writing element is disposed within the housing and an extended position in which the writing element is advanced beyond the first end of the housing. In its fully extended position, the extension means substantially multiplies the overall effective length of the writing implement so that it can be held comfortably in the hand.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 1:
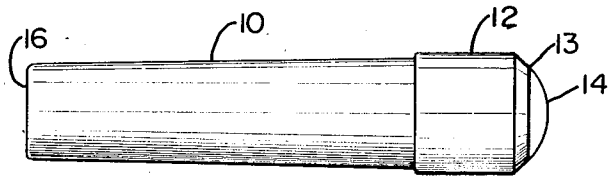
FIG. 1 is a side view in elevation showing a preferred form of the extendable writing implement with the writing element and the extension means retracted within the housing.
Figure 2:
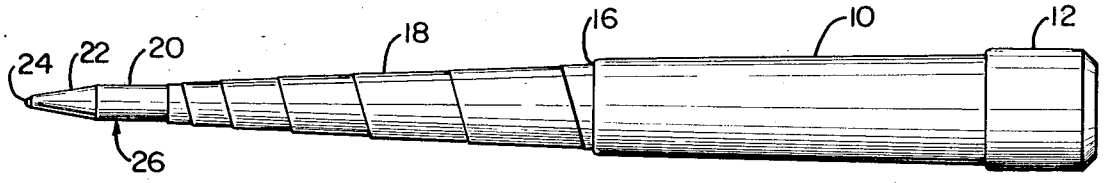
FIG. 2 is a side view in elevation showing a preferred form of the extendable writing implement with the writing element and extension means in the extended position.

Referring to the drawings, FIG. 1 shows a preferred form of an extendable writing implement or instrument retracted within a housing 10. The housing 10 is generally tubular in shape with a slight taper from a wider opening 17 to a narrower opening 16. An annular collar 12 having an internal thread 62 is disposed in surrounding relation to opening 17 and cooperates with locking means described in greater detail hereinbelow. In FIG. 2, the writing instrument is shown in its fully extended position with extension means 18 for a writing element in the form of a cartridge 26 projecting through opening 16 into a locked position beyond the housing 10.

Figure 3:
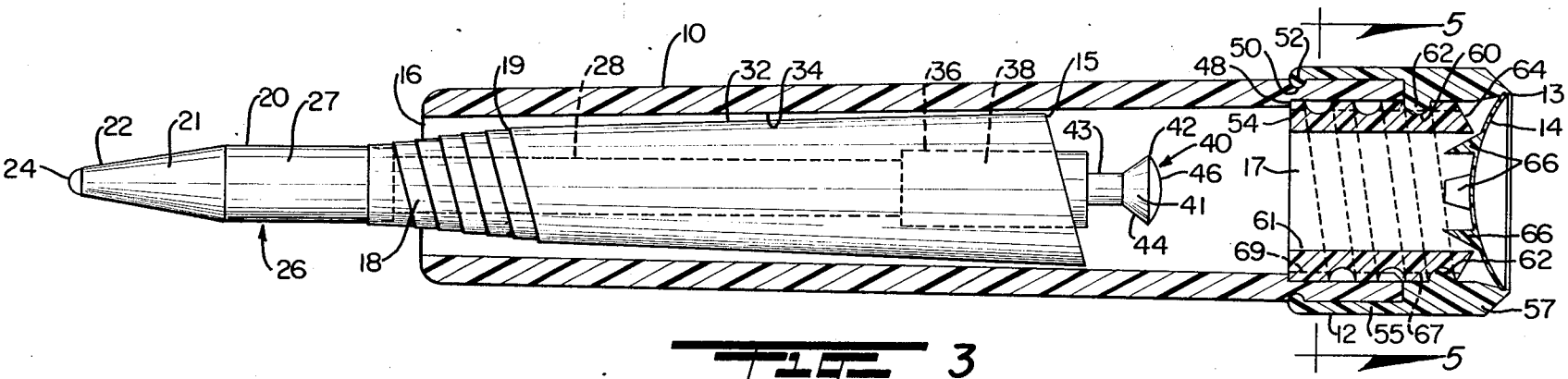
FIG. 3 is a side view of a preferred form of the extendable writing implement partially in section, illustrating the writing element and extension means in a partially extended position and the retaining means in the unlocked position.

As shown in FIG. 3, the writing cartridge 26 is mounted at one end of the extension means 18 which is disposed in inner concentric relation to the housing 10. The writing cartridge 26 is generally cylindrical in shape and comprises a forward end 21, an intermediate portion 28 and a rearward support end 40. The intermediate portion 28 comprises an elongated central portion of reduced diameter and first and second shoulders 27 and 38, respectively. The operative end 21 extends forwardly from the first shoulder 27 and has a tapered portion 22 which terminates in a writing tip 24. The support end 40 extends rearwardly from the second shoulder portion 38 and includes a cylindrical portion 43 of reduced diameter with a support head 42 which is engageable with a retaining means described in greater detail hereinbelow. The support head 42 has a generally diamond-shaped profile, as shown in FIG. 3, and includes a truncated conical portion 41 having sloped faces 44 and and a rounded end surface 46.

Figure 4:
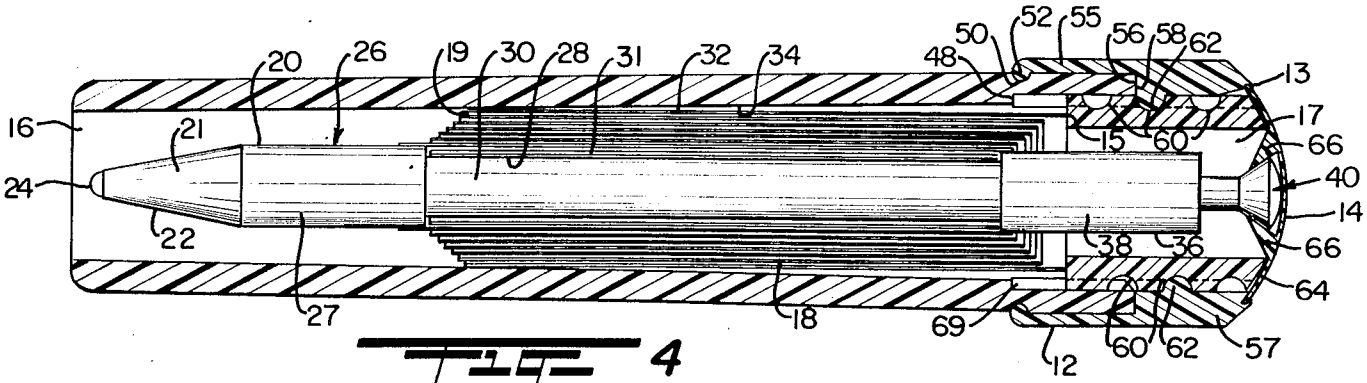
FIG. 4 is a side view of a preferred form of the extendable writing implement partially in section and illustrating the writing element and extension means in the retracted position and the support end of the writing element captured by the retaining means.

An important feature of the present invention resides in the extension means 18 which is defined by a helical coil member formed of a thin flat sheet into a plurality of turns and having at one terminal end an inner face 31 and at its opposite terminal end an outer face 32, as shown in FIGS. 3 and 4. The inner face 31 of the extension means encircles the external surface of the central portion 28 of the writing cartridge, the width of the inner face being such that it traverses the length of the portion 28 with opposite edges abutting the shoulders 27 and 38, as best seen from FIG. 4. Preferably, the helical coil is spring-loaded or pretensioned to urge the cartridge 26 in a forward direction through the forward end 16 of the housing, or in other words, to advance between the generally cylindrical arrangement of the turns as shown in FIG. 4 to the conical arrangement as shown in FIG. 3.

When the writing cartridge 26 is retained within the housing, as shown in FIG. 4, the extension means or coil member 18 is retracted into a generally cylindrical configuration, the width of the turns of the helical member corresponding generally to the overall length of the central portion 28 and with a forward edge 19 of the extension means or coil 18 in contact with and bearing against the inner surface 34 of the housing 10. In this relation, the outer diameter or turn of the helical coil is uniform or approximately equal between its forward edge 19 and rearward edge 15. However, when the forward edge 19 of the coil 18 is in contact with the inner surface 34, the rearward edge 15 is spaced somewhat from the surface 34, since the inner diameter of the housing 10 is wider at the point opposite to the rearward edge 15. However, as the writing cartridge is extended or advanced forwardly through the housing to the position shown in FIG. 3, the outer face 32 of the coil will slide forwardly along the housing until the rearward end 15 moves into frictional engagement with the housing while at the same time the forward edge 19 will contract inwardly away from engagement with the housing. As previously stated, the coil member 18 is preferably biased to automatically extend forwardly through the housing when released from its retained position and, in so doing, the turns of the helical coil will simultaneously rotate and contract inwardly to assume the somewhat conical configuration as illustrated. By grasping the forward end 20 of the cartridge 26 and continuing to draw the helical coil member 18 forwardly away from the housing, the turns of the coil will continue to contract and rotate until adjacent turns move into close frictional engagement with one another and the rearward edge 15 of the outer face 32 of the coil 18 advances into firm frictional engagement with the inner surface 34 of the housing 10. The frictional locking of coil 18 can be enhanced by texturing the inner and outer surface areas of the coil such that when in close contact with one another, such as, the extended position they are resistant to surface-to-surface motion.

Figure 6:
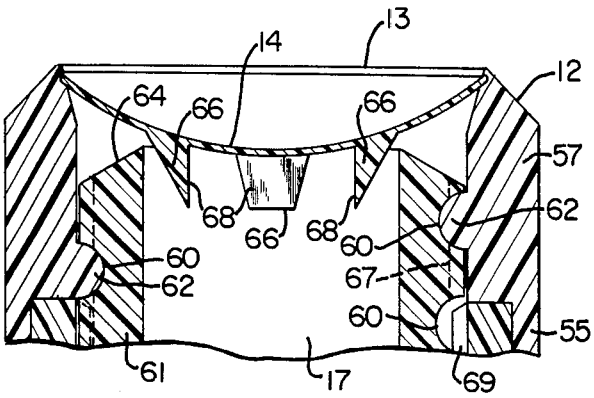
FIG. 6 is an enlarged view partly in section illustrating details of a preferred form of the retaining means of the present invention in the released position.
Figure 7:
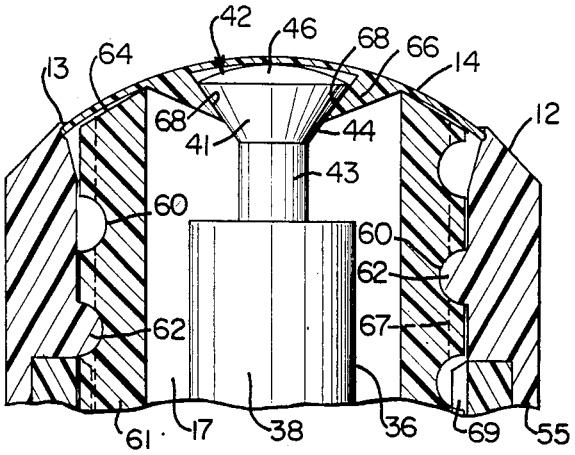
FIG. 7 is an enlarged view partly in section illustrating details of a preferred form of the retaining means of the present invention with a writing element captured in the retained position.
Figure 8:
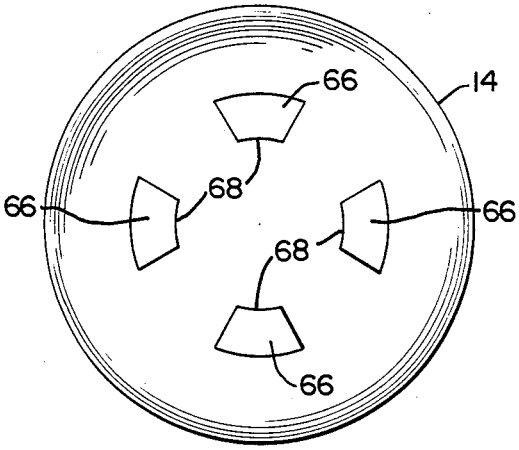
FIG. 8 is an end view of a preferred form of the retaining means of the present invention in the released position.
Figure 9:
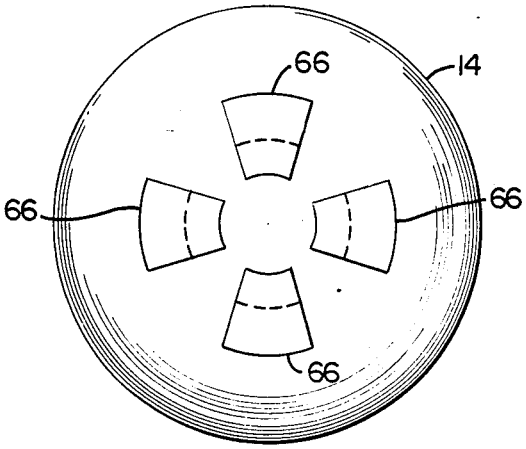
FIG. 9 is an end view of a preferred form of the retaining means of the present invention in the retained position.
Figure 5:
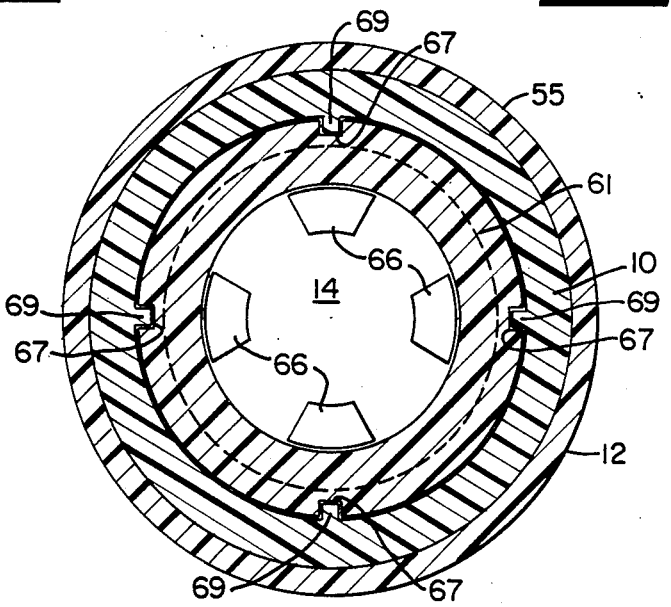
FIG. 5 is a sectional end view of a preferred form of the retaining means of the present invention taken about lines 5—5 of FIG. 3.

The retaining means for retaining the cartridge 26 in the retracted position comprises a flexible cap or diaphragm 14 having protrusions 66 for capturing the support end 40 of the cartridge 26. Locking means which is operable to bias the retaining means into the retained or convex position comprises an annular collar 12 disposed in surrounding relation to the rearward opening 17 of the housing 10 and an inner sleeve 61 which cooperates with the annular collar 12 to bias the flexible cap or diaphragm 14 into the retaining position. The annular collar 12 includes a thickened body portion 57 and a forwardly extending wall 55 of reduced thickness. The collar 12 is retained on the housing 10 by a lip 52 on the forwardly extending wall 55 which is received in a complementary annular groove 50 adjacent to the wider opening 17 of housing 10. The flexible cap or diaphragm 14 is generally disk-shaped, as shown in FIGS. 8 and 9, and is hingedly mounted under slight compression on the outer peripheral edge 13 of the collar 12 so that the diaphragm 14 may assume either a concave or convex curvature with respect to the collar 12, as is shown in FIGS. 6 and 7, respectively. The flexible diaphragm 14 includes circumferentially spaced protrusions or gripping fingers 66 arranged in a radial pattern on the interior of the diaphragm 14, as shown in FIGS. 8 and 9. When the cap is flexed inwardly into a concave position, as shown in FIG. 6, the protrusions 66 are spread outwardly to reveal relatively flat surfaces 68 which are generally parallel to the longitudinal axis of the housing 10 and are disposed in outer surrounding relation to the truncated cone portion 41 of the support head 42. As the cartridge is retracted, the support head 42 is engaged by the retraction of the fingers 66 and the flexible diaphragm 14 is moved into its convex position, as shown in FIG. 7. In this position, the inner faces 68 of the protrusions 66 will grip the sloped faces 44 of the truncated conical portion 41 of the support head 42, thus retaining the cartridge and extension means 18 in the retracted position.

In the retracted position, the flexible diaphragm 14 preferably is secured in the convex position by sloped edges 64 of inner sleeve 61, although it will be evident that rearward retraction of the end 40 against the cap 14 may be employed to force the cap into the convex, retaining position without the aid of additional locking means now to be described. The sleeve 61 has a helical groove 60 which cooperates with a complementary thread 62 on the inner surface of the thickened body portion 57 of annular collar 12 to move the sleeve 61 within the housing in response to twisting of the collar 12. The sleeve 61 is guided along the longitudinal axis of the housing 10 by circumferentially spaced tongues 69 on the inner surface of housing 10 which are received in grooves 67 of the sleeve 61 as it moves from its inner position to its outer position. The inner position is defined by contact of the forward surface 54 of the sleeve 61 with a shoulder 48 on the inner surface of housing 10; and the outer position is defined by contact of sloped edges 64 of the sleeve 61 with the flexible diaphragm 14.

In use, and assuming that the writing instrument is initially in its retracted position, the writing cartridge 26 is extended by twisting the annular collar 12 to move the inner sleeve 61 away from the flexible diaphragm 14. The diaphragm 14 is then depressed into its concave configuration to release the support head 42 of the cartridge 26 from the protrusions 66 whereupon the extension coil 18 is free to spring forwardly to advance the cartridge 26 through the end 16 of the housing 10. The cartridge 26 is fully extended into its operative position by grasping the portion 20 of the cartridge 26 and pulling the cartridge 26 and extension means 18 through the end 16 of the housing 10. As the extension means 18 is drawn from the housing 10, the outer surface 32 of the extension means 18 is advanced into frictional engagement with the inner surface 34 of the housing. Simultaneously, the turns of the helical coil will undergo outward spiraling and contraction into tight overlapping frictional engagement whereby the coil and cartridge are locked in their operative extended position. In this position, the writing instrument can be grasped in a conventional manner along the forward end surface 20 of the cartridge 26 with the helical coil 18 resting in the crotch between the thumb and index finger.

The writing cartridge 26 may be returned to its retracted position by grasping the housing 10 and twisting the cartridge to release the turns of the coil member 18 from their frictional engagement then pushing the operative end of the cartridge 26 rearwardly into the housing so as to cause the coil 18 to be returned to its generally cylindrical configuration as illustrated in FIG. 4. As the cartridge 26 moves rearwardly into the housing the support end 40 is received between the protrusions 66 on the flexible diaphragm 14 and causes the diaphragm 14 to move into its convex position in order to capture the support end 40 in the retracted position. Again, in the preferred form, the cartridge 26 and the flexible diaphragm 14 can be locked in the retained position by twisting the annular collar 12 to move the sloped edges 64 of the inner sleeve 61 into contact with the flexible diaphragm 14. The result is a very compact configuration allowing the writing implement to be conveniently stored in the user's pocket or purse.

It will be evident that the writing element or cartridge 26 may be replaced by disassembling the cap or retaining means at the rearward end of the housing and removing the cartridge 26 and coil 18. Once removed, both the coil and cartridge may be replaced, or the cartridge 26 removed from the coil and replaced with a fresh cartridge. In the alternative, it will be evident that the end of the cartridge forwardly of the central portion 28 may be inserted into the central portion, such as, by threading or pressfit engagement so as to enable its replacement without disassembly of the entire writing instrument.

Accordingly, although the present invention has been described with particularity relative to the foregoing detailed description of the preferred embodiment, various modifications, changes, additions and applications other than those specifically mentioned herein will be readily apparent to those having ordinary skill in the art without departing from the spirit and scope of this invention.

I claim:

1. In an extendable writing implement, the combination comprising:

a tubular housing having an inner surface, an outer surface, and first and second ends, a cylindrical writing element insertable within said housing having an operative end extendable through said first end of said housing, a support end releasably retainable in said second end of said housing and axially spaced external shoulders between said operative end and said support end;

releasable retaining means disposed adjacent to said second end of said housing, said retaining means operative to engage said support end and releasably retain said writing element within said housing; and extension means received in said housing and disposed between said housing and said writing element, said extension means including a helical coil member having an outer portion engageable with said inner surface of said housing and an inner portion disposed in closely surrounding relation to said writing element between said shoulders on said element, said inner portion freely rotatable with respect to said writing element, said extension means being movable between a retracted position in which said support end of said writing element is retained in said second end of said housing and an extended position in which said operative end of said writing element is advanced beyond said first end of said housing, and said coil member pretensioned in a direction to urge said writing element toward said extended position.

2. In an extendable writing implement according to claim 1, said tubular housing being tapered to define a narrower opening at said first end and a wider opening at said second end.

3. In an extendable writing implement according to claim 1, said helical coil member comprising overlapping portions frictionally engageable in interlocking relationship to releasably secure extension means in said extended position.

4. In an extendable writing implement, the combination comprising:

a tubular housing having an inner surface, an outer surface, and first and second ends, a cylindrical writing element insertable within said housing having an operative end extendable through said first end of said housing and a support end releasably retainable in said second end of said housing;

releasable retaining means disposed adjacent to said second end of said housing, said retaining means including a flexible cap having a plurality of unitary gripping protrusions protruding from an inner surface of said cap and engageable with said support end, said cap being of concavo-convex configuration and disposed at said second end of said housing, said cap being depressible inwardly into a concave configuration to cause said gripping protrusions to spread into outer surrounding relation to said support end and said cap being flexible outwardly into convex configuration upon retraction of said writing element through said housing into engagement with said cap to cause said gripping protrusions to be retracted into gripping engagement with said support end whereby said retaining means is operative to releasably retain said writing element within said housing; and extension means received in said housing and disposed between said housing and said writing element, said extension means comprising a plurality of turns of a pretensioned helical coil member having an outer turn portion engageable with said inner surface of said housing and an inner turn portion engageable with said writing element, said extension means being movable between a retracted position in which said support end of said writing element is releasably retained in said second end of said housing by said retaining means and an extended position in which said operative end of said writing element is advanced beyond said first end of said housing, said coil member pretensioned in a direction to urge said writing element toward said extended position.

5. In an extendable writing implement according to claim 4, said flexible cap being generally circular with said protrusions integrally united to said cap at spaced circumferential intervals along an inner concentric radius of said cap.

6. In an extendable writing implement according to claim 5, said retaining means including an annular collar disposed in surrounding relation to said second end of said housing, said collar having an inner surface and an outer surface, a helical thread on said inner surface, and said collar further including fore and aft peripheral edges.

7. In an extendable writing implement according to claim 6, said retaining means including a generally circular flexible cap having an inner portion and a peripheral edge hingedly received on said aft peripheral edge of said annular collar and attached thereto, said cap further including inner gripping protrusions engageable with said support end of said writing element.

8. In an extendable writing implement according to claim 7, said cap being flexible inwardly to cause said gripping protrusion to spread into outer surrounding relation to said support end and said cap being flexible outwardly upon retraction of said writing element into said housing to cause said gripping protrusions to be retracted into gripping engagement with said support end.

9. In an extendable writing implement according to claim 8, said retaining means including an inner sleeve received in said second end of said housing, said inner sleeve being generally tubular in shape and including an inner surface, an outer surface, and first and second ends.

10. In an extendable writing implement according to claim 9, said inner sleeve further including a helical groove in said outer surface of said sleeve mating with said helical thread on said inner surface of said annular collar.

11. In an extendable writing implement according to claim 10, said first end of said inner sleeve receivable within said second end of said housing and said second end having sloped edges engageable with said inner portion of said flexible cap, said sleeve further being extendable in cooperation with said annular collar between an inner position wherein said sleeve is substantially disposed in inner concentric relation to said second end of said housing and on outer position wherein said sloped edges of said sleeve engage said flexible cap to prevent inward flexible movement of said cap.

* * * * *